United States Patent [19]

Rodriguez

[11] Patent Number: 4,478,125

[45] Date of Patent: Oct. 23, 1984

[54] PIANO SOUND BOARD

[76] Inventor: Domingo H. Rodriguez, Avda. Guzman Blanco Ota Corubo, Los laureles El Paraiso, Caracas, Venezuela

[21] Appl. No.: 441,788

[22] Filed: Nov. 15, 1982

[51] Int. Cl.[3] ..... G10C 3/04

[52] U.S. Cl. ..... 84/212

[58] Field of Search ..... 84/173, 174, 197, 198, 84/212, 213, 264, 265, 285

[56] References Cited

U.S. PATENT DOCUMENTS

| | | | |
|---|---|---|---|
| 671,997 | 4/1901 | Fullerton | 84/173 |
| 1,239,050 | 9/1917 | Smith | 84/264 |
| 1,282,636 | 10/1918 | Schenuit | 84/285 |
| 1,702,643 | 2/1929 | Claiborne | 84/264 |

FOREIGN PATENT DOCUMENTS

| | | | |
|---|---|---|---|
| 71666 | 5/1916 | Austria | 84/174 |

*Primary Examiner*—Donald A. Griffin

*Attorney, Agent, or Firm*—Murray Schaffer

[57] ABSTRACT

A piano sound board having an upper bridge, and a lower bridge arranged at an angle to each other in a common plane. A plurality of strings following the harmonic progression $$\frac{176}{175}\ \frac{176}{173}\ \frac{176}{171}\ \text{----}\ \frac{176}{5}\ \frac{176}{3}\ \frac{176}{1}$$

secured between the bridges, at right angles to the upper bridge.

6 Claims, 2 Drawing Figures

PIANO SOUND BOARD

BACKGROUND OF THE INVENTION

The present invention relates to the construction of pianos and in particular to the sound board of a piano.

It is well known that pianos are constructed so that the sounds produced conform to the values of the Diatonic Scale or "natural" notes following the harmonic ratios: 1. —9/8—5/4—4/3—3/2—5/3—15/8—2. These values are successively doubled till that of the last string of the piano, or highest pitch encompassed, is of the value 271.257, usually the lowest sound, i.e. the first string is chosen to be 5/3, and the total number of strings employed is 88.

The internal values of the successive scales, or "Octaves" are modified in what is referred to as the "Equal Temperment Tuning" by the geometrical division of each octave into twelve equal parts, which division supposedly contains the eight "natural" notes of the scale plus an altered version of all of them but two. Thus there is finally obtained a geometrical series of values equal to the 12th root of 2. This is the method employed at least since the time of Bach.

As a result of the numerical conditions imposed for the sounds of the conventional piano, the strings are submitted to great and varying tensions which require irregular changes in the length of the strings and variation in their tension. This in turn requires that in the sound board, groups of strings be arranged on different planes or layers and that the piano frame be provided with beams, bridges and girders of enormous strength and resistance to hold the strings under the necessarily high tension.

As a consequence, of the conventional method, of forming sound boards, the process of hammering, or "action", i.e. the system of levers required to finally strike the string in different directions, is very complicated; with the result that such devices are made by firms specializing in such units alone, rather than by the piano manufacturer himself.

As will therefore be seen, the construction of the sound board of a piano which provides acurately and with certainty 88 sounds geometrically measured and distinct, is very complicated and difficult.

It is the object of the present invention to provide a novel construction for a piano sound board overcoming the problems and disadvantages of the prior art.

SUMMARY OF THE INVENTION

According to the present invention a sound board is provided where the disposition of the bridges and strings are such that: firstly, the dimensions of the supporting beams and/or girders, fixing the strings, will be considerably reduced; secondly, that all the strings will be located on a unique or single plane and all the strings will be parallel, and, finally the sounds obtained will be harmonially organized so that it will be a truly musical instrument comparable to the high standards now required.

DESCRIPTION OF THE INVENTION

Before turning to the drawings of the embodiments of the invention, it must first be realized that the new piano sound board will not be organized in accord with either the diatonic scale or the "equal temperment" division by the 12th root of 2. Instead, a general harmonic division of the realm of melody into 176 parts, with the first or lowest pitch string in the series not of the ratio (176/176 ) (1) but of (176/175). The harmonic series is thus constructed of 88 values as follows:

$$\frac{176}{175}\ \frac{176}{173}\ \frac{176}{171}\ \frac{176}{169}\ \frac{176}{167}\ \text{---}\ \frac{176}{9}\ \frac{176}{7}\ \frac{176}{5}\ \frac{176}{3}\ \frac{176}{1}$$

It can thus be immediately seen that the most important difference between the present invention and the conventional piano is that the series employed here does not contain any octave of fundamental sound while in the old systems the use of various octaves is absolutely necessary.

The sounds of the new series can be obtained by the use of strings of the same diameter, arranged parallel to each other, and under relatively little tensional variation. Thus, the beams and bridges can be significantly reduced in dimension and needed strength.

Figure 1:
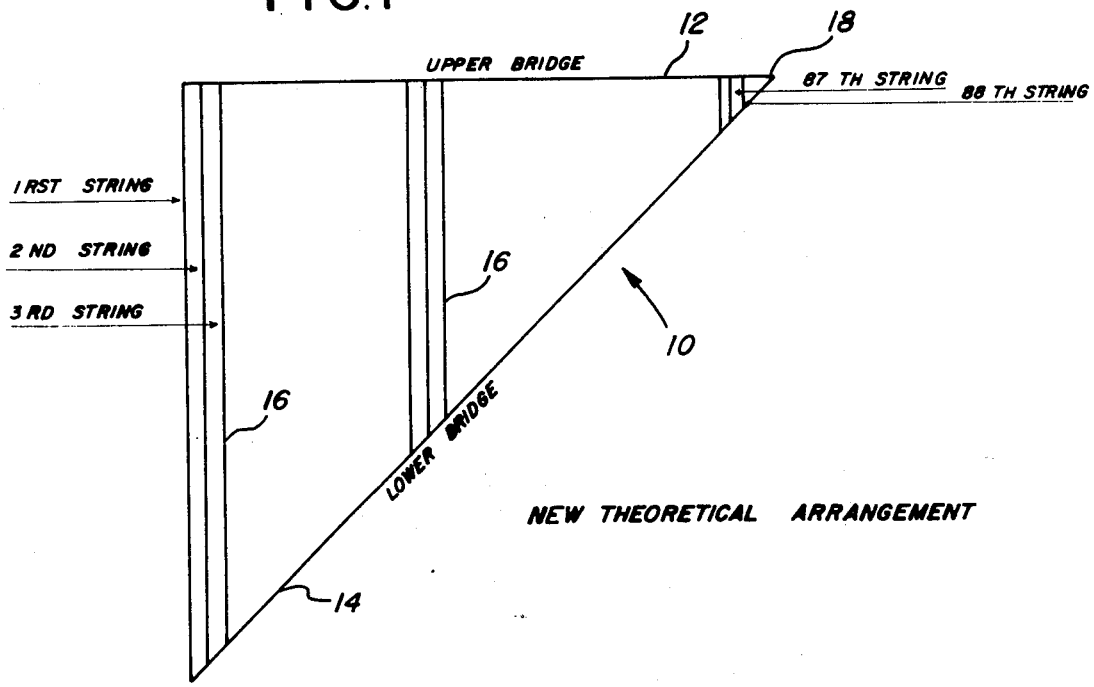
FIG. 1 is a schematic view of arrangement strings and sound board according to the present invention.

Turning now to FIG. 1, the sound board of the present invention generally depicted by the numeral 10 comprises simply a horizontal beam or upper bridge 12 and a lower bridge 14 set at angle to the horizontal bridge. Both bridges 12 and 14 are linear or straight members made of materials conventionally used, but of lighter or reduced dimentions. The strings 16 are attached between the bridges at predetermined or uniform intervals parallel to each other, in conventional manner. Preferably, the strings are attached to at least the horizontal upper bridge, by tuning pins, so that relative adjustments can be made, due to differences in tolerance inherent in manufactured items such as the strings themselves and/or the bridges. The length of the bridges and their angular disposition relative to each other is determined by the length of the longest, or lowest pitched string. As a result of this arrangement the longest string and the two bridges define a right triangle, with the lower bridge forming an acute angle at the end 18 of the upper bridge. The bridges and strings lie in a common plane and the only variation is in the length of each string which decrease uniformly from the first to the 88th string.

The sound board shown in FIG. 1 can be employed in a horizontal as well as a vertically or upright framed piano housing.

Figure 2:
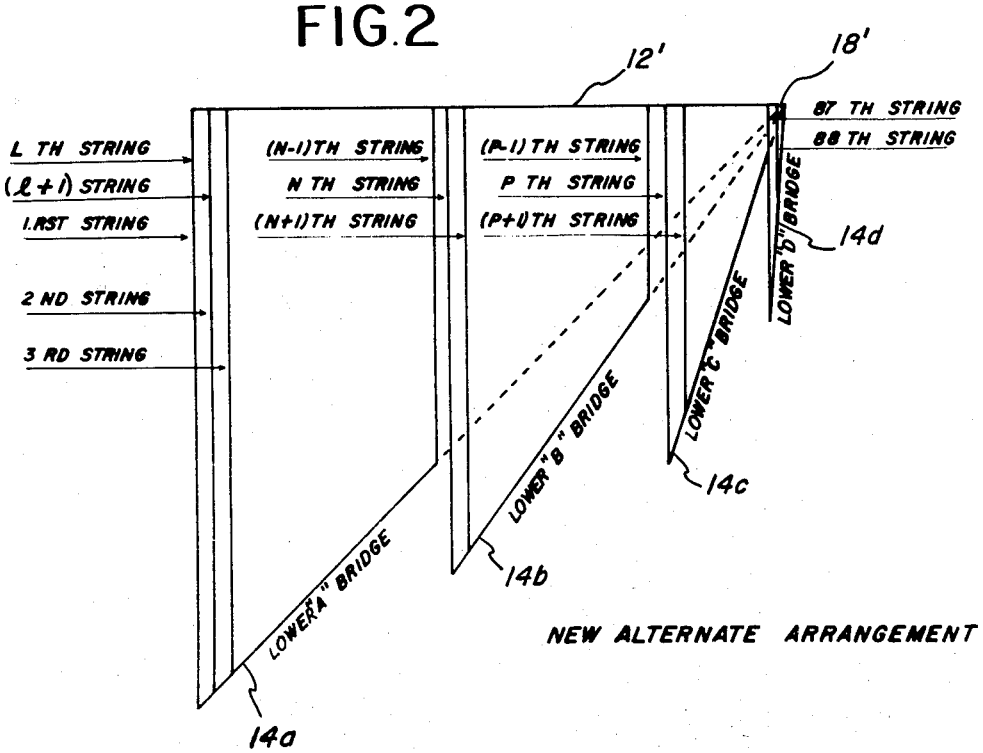
FIG. 2 is a view similar to that of FIG. 1 showing another embodiment of the present invention.

In FIG. 2 another embodiment is shown wherein it might be convenient to group the strings into several groups. While four such groupings A—B—C and D are shown more or less are possible, although probably five groups may be the ultimate required. In this arrangement a single horizontal or upper bridge 12' is provided, and a plurality of lower bridges 14*a*, 14*b*, 14*c* and 14*d* are provided corresponding in number to the groupings of the strings 16. The lower bridges are all set at angle to the upper bridges so that three extensions, shown by the dash lines all coincide at the end of the upper bridge 18'.

The strings are attached, as in the embodiment of FIG. 1, to the common upper bridge 12' and to the respective lower bridge corresponding to its grouping. In this embodiment, the first string in each grouping, L, N, P, etc., are the longest in each of their respective groups; the first string in each succeeding group being also longer than the last string in the preceding group (vis: N and N-1; P and P-1 for example). Thus, the length of each of the lower bridges and the angle made with the horizontal bridge will vary depending on the length of the first and last strings as well as the number of strings in each grouping. Nevertheless, all the strings are arranged parallel to each other, at regular intervals, and in a common plane.

It is to be understood that while the present invention establishes a new arrangement for the strings and the sound board elements, these strings and elements, and the method and means for interconnecting them can per se be conventional components, and no new technology need be employed to make strings, bridges, beams or sound board elements.

However, because of the simplification created by the present invention, light, reduced sized materials can be used, less complex means for tensioning the strings employed, and various other designs for frames and housings, both for horizontal and upright pianos can be developed. Further, because the strings are all parallel to each other and on the same common plane, the hammer lever system or action can be greatly simplified as well.

Since various embodiments, modifications and changes have been shown and described, and others will be obvious to those skilled in this art from this description, it is intended that the foregoing description be taken as illustrative only and not as limiting the scope of this invention.

What is claimed is:

1. A piano sound board comprising an upper bridge a plurality of lower bridges each set at an angle to the upper bridge and in a common plane therewith, the extensions of said lower bridges coinciding at one end of said upper bridge, a plurality of strings arranged in a number of groups corresponding to the number of lower bridges, the strings in each group being secured at one end to the upper bridge and at the other end to the respective lower bridge corresponding to said grouping, said strings extending at right angles to said upper bridge, the longest of said strings in each group defining with the upper bridge and the corresponding lower bridge at least a portion of a right triangle, the remaining strings in each group being arranged parallel thereto at regular intervals.

2. The piano sound board according to claim 1 wherein each group lies successively adjacent each other and the first string in each group is longer than the last string in the preceeding group.

3. The piano sound board according to claim 2 when said strings are arranged in a harmonic progression of 88 values having the following ratios $$\frac{176}{175}\ \frac{176}{173}\ \frac{176}{171}\ \text{---}\ \frac{176}{5}\ \frac{176}{3}\ \frac{176}{1}$$

4. The piano sound board according to claim 3 wherein said strings are of uniform diameter.

5. The piano sound board according to claim 4 wherein said strings are spaced uniformly along said upper bridge.

6. The piano sound board according to claim 2 including means for adjusting the tension on each of said strings.

* * * * *